United States Patent [19]

Melzer

[11] 4,260,149

[45] Apr. 7, 1981

[54] SHEET REGISTRATION ON FEED TABLE OF PRINTING PRESS

[75] Inventor: Rudolf Melzer, Hainburg, Fed. Rep. of Germany

[73] Assignee: M.A.N.-Roland Druckmaschinen Aktiengesellschaft, Fed. Rep. of Germany

[21] Appl. No.: 66,532

[22] Filed: Aug. 15, 1979

Related U.S. Application Data

[63] Continuation-in-part of Ser. No. 45,885, Jun. 6, 1979, abandoned.

[30] Foreign Application Priority Data

Jun. 7, 1978 [DE] Fed. Rep. of Germany ..... 2824932

[51] Int. Cl.[3] ..... B65H 9/10

[52] U.S. Cl. ..... 271/236; 271/195; 271/250; 271/241

[58] Field of Search ..... 271/236, 237, 241, 250, 271/252, 238, 226, 194, 239, 240, 231, 234, 248, 249, 227, 228, 195, 108

[56] References Cited

U.S. PATENT DOCUMENTS

| | | | |
|---|---|---|---|
| 2,995,359 | 8/1961 | Gulick | 271/108 |
| 3,860,233 | 1/1975 | Wiase | 271/241 X |
| 4,093,083 | 6/1978 | Klaus | 271/194 X |
| 4,164,349 | 8/1979 | Marass | 271/250 |

FOREIGN PATENT DOCUMENTS

| | | | |
|---|---|---|---|
| 617605 | 8/1935 | Fed. Rep. of Germany | 271/250 |
| 1072913 | 6/1967 | United Kingdom | 271/195 |

*Primary Examiner*—Bruce H. Stoner, Jr.

*Attorney, Agent, or Firm*—Leydig, Voit, Osann, Mayer & Holt, Ltd.

[57] ABSTRACT

A mechanism for registering a sheet against front and side stops on the feed table of a printing press, employing a suction head recessed in the table and reciprocated for lateral shifting movement in the direction of the side stop timed with the arrival of the sheet. The head is connected to a source of suction so that the sheet is shifted into contact with the side stop. The head has intentional play in the direction of feeding movement of the sheet, as measured from a reference position, and is freely rockable about its axis, so that the sheet is free to settle against the front stop at the same time that it is being shifted toward the side stop. A conduit connected to a source of a pressure is provided for applying a short puff of air to the head, timed with completion of the shifting movement, to free the sheet from the head in readiness for removal of the sheet from the table. The return movement of the head is utilized to reverse the play and to restore the head to reference position. In the preferred embodiment of the invention the head is mounted upon a reciprocated slide which is slidable upon a tube which serves as an air conduit. Also in the preferred form of the invention the same drive shaft is employed in a compactly integrated construction to obtain the reciprocating movement and for rotating air valves to insure high speed synchronization.

19 Claims, 15 Drawing Figures

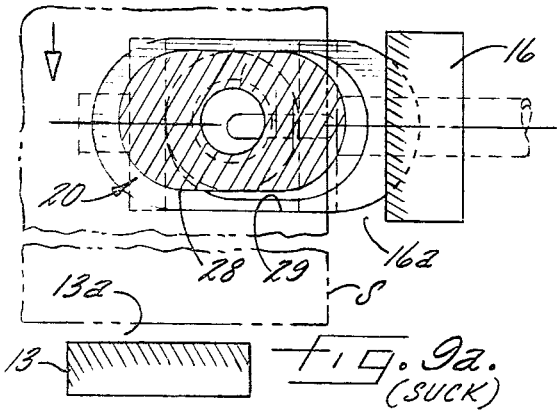
FIG. 9a. (SUCK)
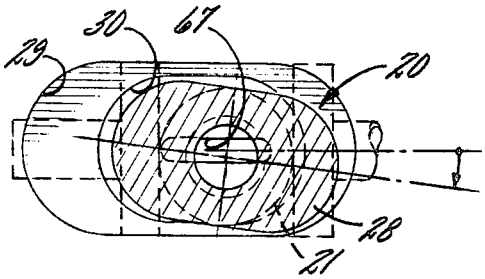
FIG. 10a.
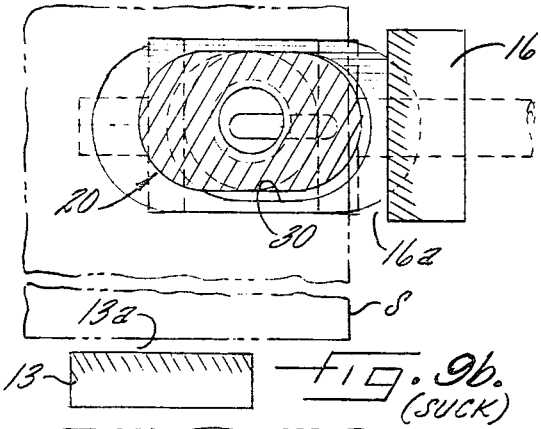
FIG. 9b. (SUCK)
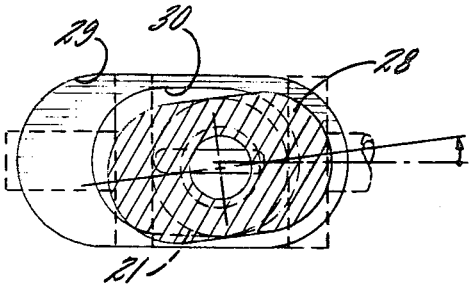
FIG. 10b.
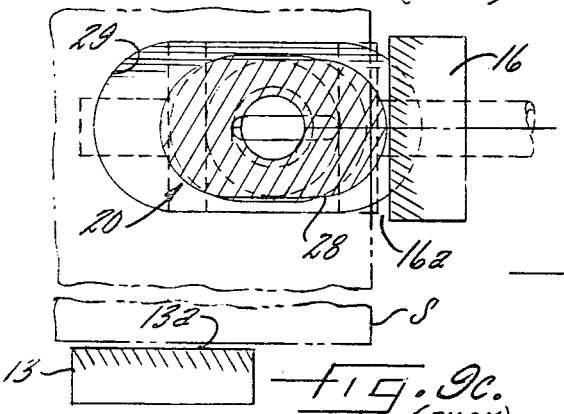
FIG. 9c. (SUCK)
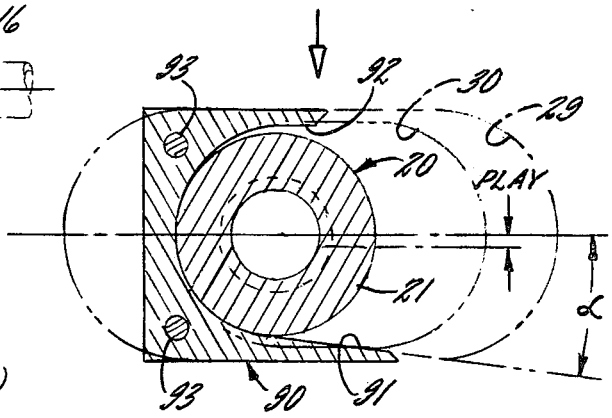
FIG. 11.
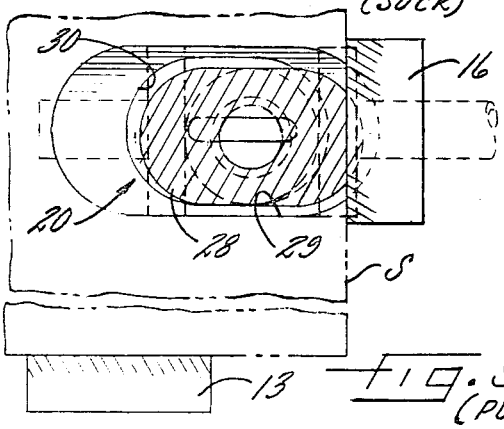
FIG. 9d. (PUFF)

SHEET REGISTRATION ON FEED TABLE OF PRINTING PRESS

This is a continuation-in-part of application Ser. No. 045,885 filed June 6, 1979, now abandoned.

In a multi-color sheet-fed printing press the sheets to be printed must be transferred to the impression cylinder of each press unit in a precise condition of register. Such condition of register is determined by engagement of the front and side edges of the sheet by stops on a feed table. It is common to employ a suction head under or in the plane of the table to urge a sheet toward the side stop to achieve "side lay". However, in known devices employing a suction head for this purpose, engagement of the sheet by the suction head may inhibit the sheet from undergoing the residual movement required for the sheet to settle against the front stop. Or, if a sheet is engaged by the suction head for lateral movement after the front stop has already been engaged, the sheet may, in the course of such movement, be pulled away from the front stop. In either event precise register at the front stop is interfered with. Also there is a tendency for the suction at the head to "hang on" after it is no longer needed. These situations are particularly troublesome at the high operating speeds of modern sheet-fed presses.

It is, accordingly, an object of the present invention to provide a reciprocated suction head for shifting a sheet, upon arrival, in the direction of a side stop, in which the suction head has freedom of movement, or play, in the direction of feeding movement of the sheet, and as measured from a reference position, so that the sheet is free to settle against the front stop at the same time that it is being shifted against the side stop. It is a related object of the present invention to provide means timed with lateral return movement, for restoring the head to its reference position, thereby insuring that the full amount of play is available for the next sheet.

It is another object of the invention to provide a mechanism for securing register of a sheet on a feed table in which the sheet moves simultaneously in the feed direction and at right angles thereto and in which the head is freely rockable about its axis to accommodate slight changes in the angle of movement of the sheet as it moves into final position.

It is a further object of the invention to provide a reciprocated suction head for urging a sheet against a side stop and which applies a short puff of pressurized air to the head timed with completion of the shifting movement to free the sheet from the head more promptly and in readiness for removal of the sheet from the table. It is a related object of the invention to provide a mechanism in which movement of the suction head is coordinated with application of suction and pressure and in which the valves for controlling the suction and pressurized air are closely integrated and precisely synchronized with the movement of the head at all including the highest operating speeds.

It is yet another object of the invention to provide a reciprocated suction head to achieve side lay on the feed table in which the length of the stroke is quickly and conveniently adjustable.

It is a general object of the present invention to provide a mechanism for registering a sheet against front and side stops on a feed table which insures that the sheet is seated in precisely registered relation against both of the stops and which achieves such condition of register more reliably and promptly than prior mechanisms enabling use on presses operated at the highest commercial speeds.

Other objects and advantages of the invention will become apparent upon reading the attached detailed description and upon reference to the drawings in which.

FIGS. *9a–9d* are a series of stop motion views showing the shifting movements of the head and sheet occurring in a typical register cycle.

FIGS. *10a* and *10b* are diagrams showing the limited, but free, rocking movement which the head can undergo to accommodate a change in angular direction of the sheet as it approaches the stops.

Figure 4:
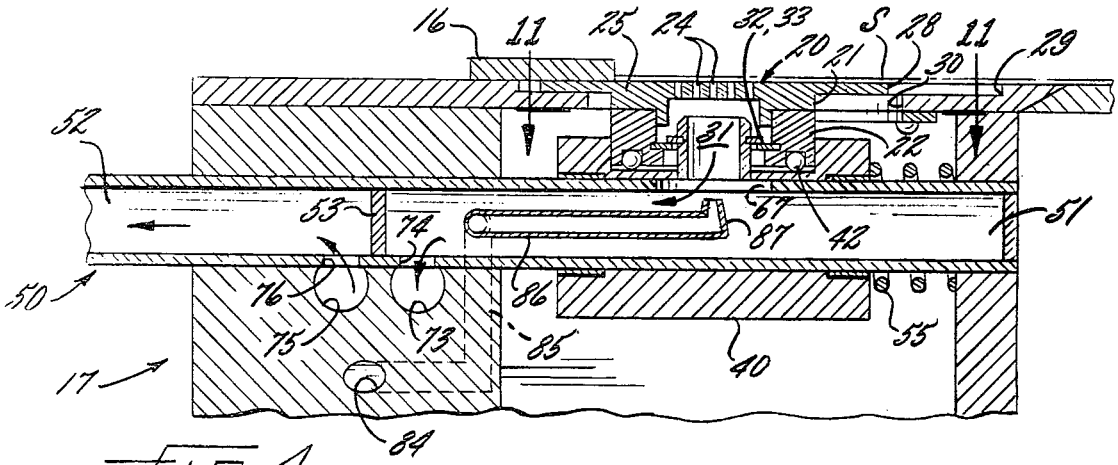
FIG. 4 is a transverse section looking along line 4—4 in FIG. 2.

FIG. 11 is a horizontal section taken through the head along line 11—11 in FIG. 4 and showing the effect of the centering fork in restoring the head to reference position in readiness for another cycle.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Figure 1:
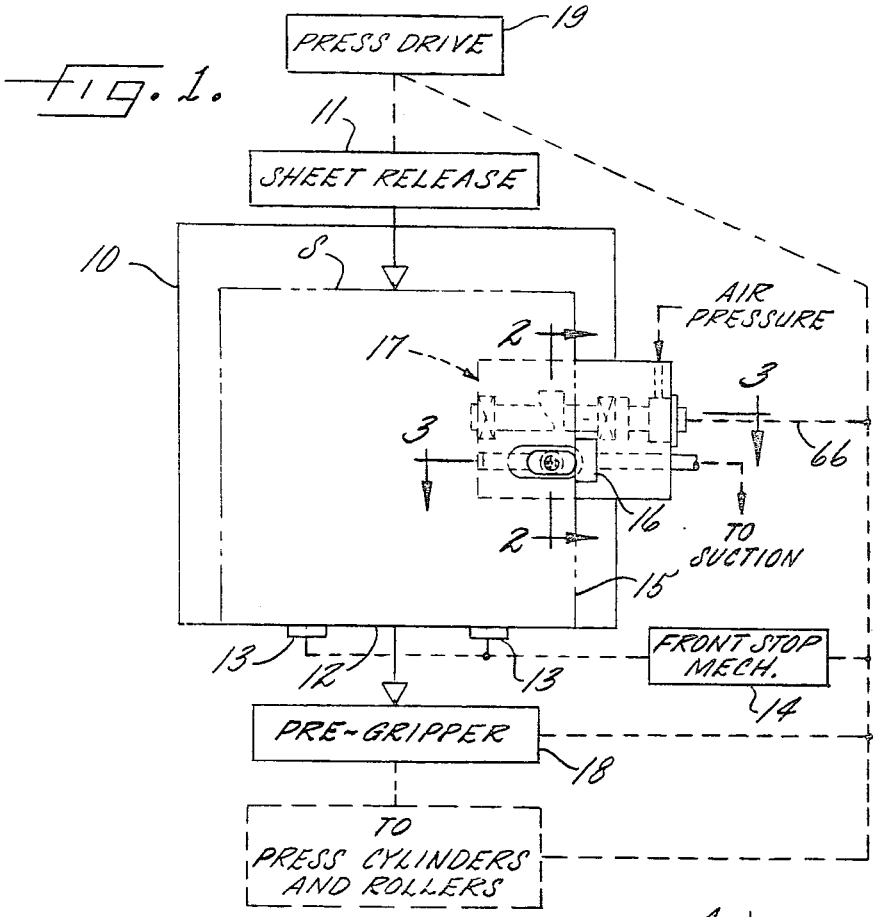
FIG. 1 shows a plan view of a feed table to which the present invention has been applied, with the drive and driven elements being shown diagrammatically.
Figure 2:
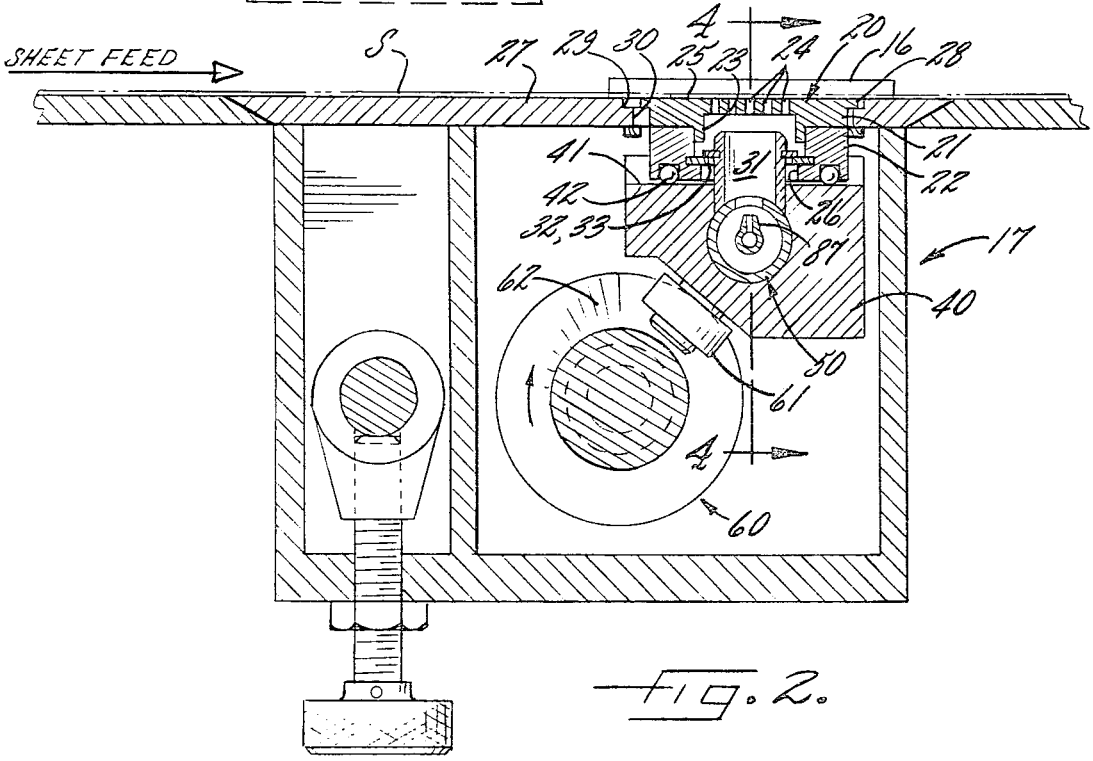
FIG. 2 is a view of the registering assembly looking along line 2—2 of FIG. 1.

Turning now to FIG. 1 there is shown, diagrammatically, in plan view, the feed table 10 at the input of a sheet-fed lithographic press unit. A sheet, indicated at S, is released by a sheet depositing, or release, mechanism 11 with forward velocity in the direction of the arrow, the velocity being sufficient so that the leading edge of the sheet 12 carries to a front stop 13 which generally, as shown, has two portions which are coupled together and which are moved between interposed and retracted positions by a front stop mechanism 14. The sheet follows a path across the table such that the lateral edge 15 of the sheet passes adjacent the side stop 16. Associated with the side stop is a side lay, or side-registering, assembly 17 constructed in accordance with the present invention and which will be described in detail. When the sheet is in registered engagement with the front and side stops it is engaged by a pre-gripper mechanism 18, per se well known to those skilled in the art, which passes the sheet to the impression cylinder of the press unit (not shown) where printing takes place. In order to insure accurate synchronism of the release, register and gripping operations, all of the mechanical elements are directly coupled to the press drive 19. Thus sheets may be fed across the table, registered, and removed at a high cyclical rate.

In accordance with the present invention a suction head is provided in the table adjacent the side stop, the suction head being reciprocated by the press drive and with suction being admitted to the head timed with the lateral shifting movement so that the sheet is shifted into contact with the side stop. Anti-friction means are provided for mounting the suction head for free play from a reference position in the direction of feeding movement so that the sheet is free to settle against the front stop as it is fed by the head toward the side stop.

In the present instance the suction head indicated at 20 is in the form of a capsule of generally cylindrical shape having an upper portion 21 and a lower portion 22 fitted together to define a central space 23. The space 23 communicates with a set of openings 24 in the top surface 25. Suction is applied to the head through a downwardly facing axial opening 26. For mounting the head so that its top surface which contains the openings is flush with the surrounding surface 27 of the table, the upper portion 21 of the head is provided with an encircling flange 28 which is seated upon a recessed land surface 29 parallel to the surface 27. As viewed in FIG. 5, the flange 28 on the head is of oval profile and the land 29, upon which the the flange seats, is of generally matching shape, but substantially larger. In addition, a clearance through-opening 30 is provided in the land 29. As a result the head is free to move parallel to the table, in both a lateral direction, as required to seat the sheet against the side stop, and, to limited degree, in the direction of sheet movement to insure that the sheet seats against the front stop 13.

For the purpose of providing communication through the opening 26 and into the central space 23 of the head while accommodating play of the head, a conduit 31 extends upwardly through the opening. Interposed between the conduit 31 and the lower portion 22 of the head is a slip type joint formed of overlapping rings 32, 33 arranged face to face with respect to one another. The rings serve to seal the head against loss of air while providing relative motion of the head parallel to the table surface together with limited rocking about the vertical head axis.

For the purpose of reciprocating the head 20 in the lateral direction it is mounted upon a slide 40 having a transverse groove 41, serving as a "way", the walls of which hold the head captive in the direction of lateral reciprocation while permitting a limited degree of play of the head in the direction of sheet movement. To insure complete freedom of the head in a direction of sheet movement an anti-friction bearing 42, in the form of a circle of balls, is interposed between the head and the way surface 41. Since the lower portion of the head 22 is circular, the head is free to rock, on the bearing, through a small angle about its own (vertical) axis, in addition to undergoing play in the direction of sheet movement. This insures that the sheet is free to undergo a change in direction during the course of its movement toward the side stop; in other words, the head does not interpose any constraint upon the sheet in the event that the sheet finds it necessary to twist in its own plane incident to seating against both of the stops.

For the purpose of guiding the slide 40 along its path of reciprocation, the slide is telescoped over a hollow suction tube 50 having an end portion 51 and a supply portion 52 which is connected to a source of suction, the two portions of the tube being separated by a permanent barrier 53. The tube is stationary, being anchored at the tip and along the length thereof to the housing.

For moving the slide, and the head, in a direction toward the side stop 16, a spring 55 is provided which encircles the tube and which presses against one end of the slide. To move the slide in the opposite direction and for the purpose of synchronizing the slide movement with the rest of the mechanism, a reciprocating connection 60 is provided which includes a cam follower 61 connected to the slide cooperating with a face type cam 62. The cam is mounted upon a shaft 63 held in anti-friction bearings 64, 65. The shaft is coupled, by means of a mechanical connection 66, to the press drive 19 (see also FIG. 1).

To provide a path from the end portion 51 of the tube to the conduit 31 in the head over the entire stroke of shifting movement of the slide, the tube is formed with an elongated slot 67. The combination of the conduit 31, which is rigidly mounted in the slide, and the slot 67 in the tube which supports the slide may be referred to for convenience as a "sliding joint".

Figure 6:
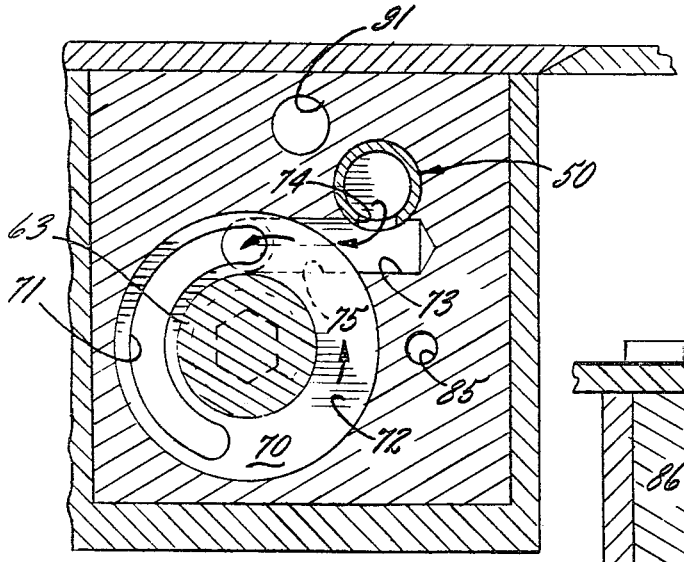
FIG. 6 is a vertical section taken through the suction portion of the valve assembly looking along line 6—6 in FIG. 3 and showing the suction valve disc in profile.
Figure 7:
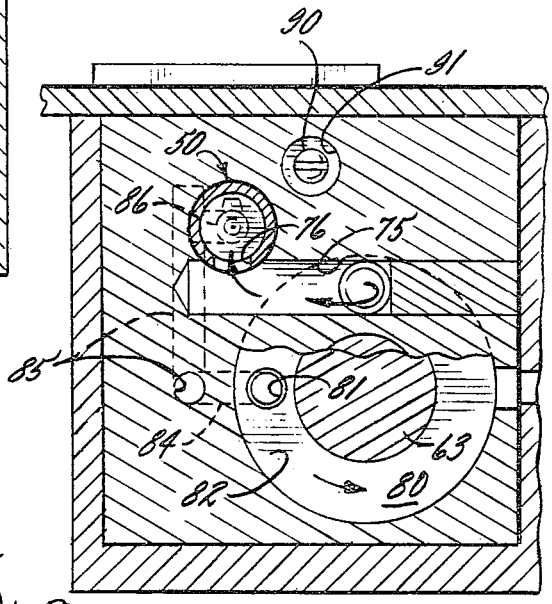
FIG. 7 is a similar view taken through the pressure portion of the valve assembly along line 7—7 in FIG. 3, showing the pressure valve disc in profile.

In order to apply suction to the head timed with the lateral shifting movement of the head, a suction valve is provided mechanically coupled to the drive shaft 63 which carries the cam 62. Such suction valve is in the form of a disc, or annulus, 70 (FIG. 6) having an arcuate port 71 and which forms one side of an annular chamber 72. The annular chamber communicates via a passageway 73 and an opening 74 with the end portion 51 of the tube 50. Communication is provided between the opposite (left-hand) side of the valve disc and the supply portion 52 of the tube through a passageway 75 and an opening 76 in the tube. Thus when the port 71 in the disc registers with the opening 75, phased with shifting movement of the head in the direction of the side stop, suction is applied at the openings 24 of the head via conduit 31, slot 67, portion 51 of the tube, passageway 73, chamber 72, port 71, passageway 75, and supply end 52 of the tube. During movement of the head in the opposite direction, away from the side stop, suction is cut off by advancement of the port 71 beyond the passage 75 with the result that at the end of the shifting stroke the head is no longer able to apply suction to the sheet. At this time in accordance with the present invention, means are provided for applying a short puff of compressed air through the head to overcome any residual vacuum and to promptly free the sheet in its registered position in readiness for removal of the sheet from the table. This is accomplished by providing a second, or pressure, valve disc on the drive shaft 63 to provide momentary communication between a source of compressed air and an auxiliary pressure tube which conducts air to a position below the suction openings in the head.

Figure 8:
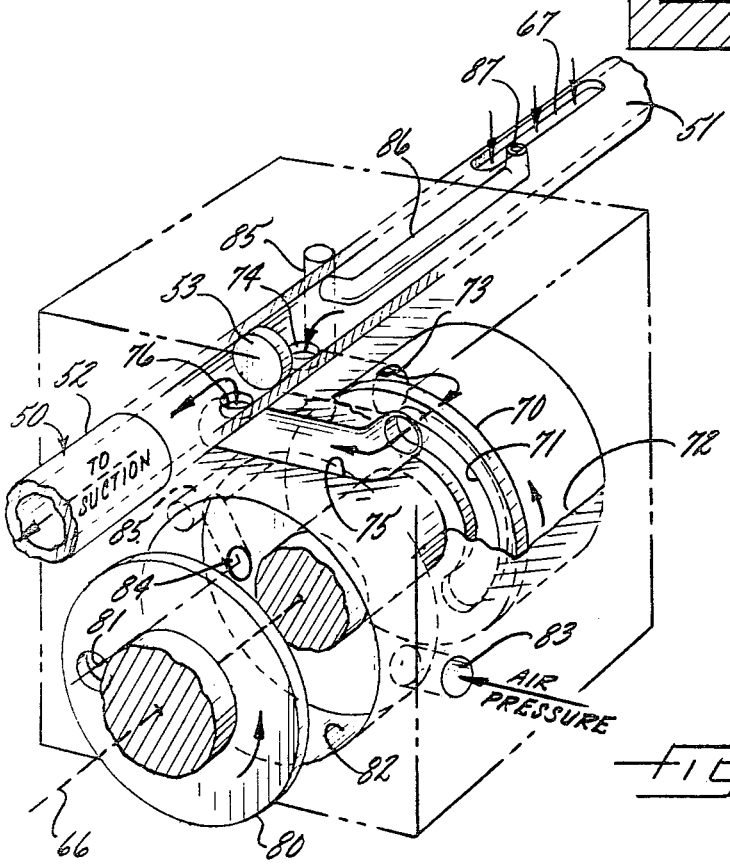
FIG. 8 is a perspective view of the valve assembly, in partial section, and showing the internal porting.

Thus there is provided a valve disc, or annulus, 80 having a port 81 and which forms one side of annular chamber 82. The annular chamber is supplied with compressed air via an inlet opening 83. On the opposite, or downstream, side of the disc 80 is a passageway 84 which communicates with an L-shaped passageway 85 terminating in an auxiliary pressure tube 86 which extends down the center of the suction tube and which terminates in an upwardly directed nozzle 87. The pressure valve disc 80 is phased to provide a puff of air timed with the completion of the shifting stroke, and it will be understood that the port positions illustrated in FIG. 8 are intended to illustrate the "port open" condition and not necessarily the relative phasing.

Figure 3:
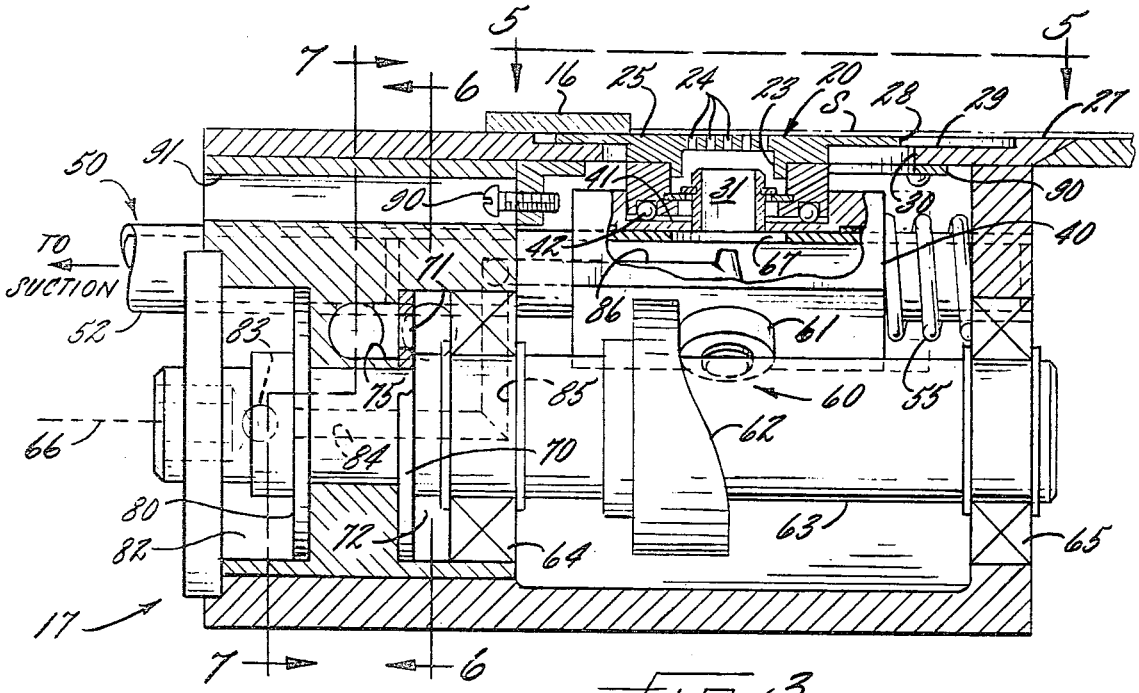
FIG. 3 is a sectional view looking along line 3—3 of FIG. 1.

It is one of the features of the present sheet shifting arrangement that the shifting stroke, in the direction of the side stop, is powered by the spring 55, that is, the shifting stroke occurs impositively. This makes it possible to interpose an adjustable stop in the path of shifting movement to determine the end point of the shift. Such a stop is incorporated in the present construction in the form of an adjusting screw 90 (FIG. 3) arranged in the path of movement of the slide 40 and accessible through a clearance opening 91. The setting of the screw determines how far the sheet will be carried by the head. Preferably the screw 90 is adjusted for a slight degree of over-travel to insure that the sheet will be carried all the way to the side stop. Such overtravel is not disadvantageous because of the impositive nature of the suction grip. Moreover, it will be apparent to one skilled in the art that the degree of suction, measured in inches of water, is subject to optimum adjustment employing a suitable pressure regulator valve (not shown).

Because of the close mechanical coupling between the cam drive and the associated valve discs and because of the short pneumatic paths within the device it is possible to achieve a high degree of synchronization between the air flow and the physical shifting movement of the head, the precise synchronization, and rapid response, being effective at all including the highest operating speeds.

A typical register cycle is illustrated in the stop motion views FIGS. *9a–9d* inclusive, in which the clearances with respect to the side and front stops, at 13*a*, 16*a*, has been exaggerated. FIG. *9a* shows a sheet S moving in the feed direction and approaching the front stop 13. As the sheet comes within a short distance of the front stop, suction is applied to the head and the head begins to move laterally to carry the sheet in the direction of the side stop 16. This sideward movement continues progressively through the positions illustrated in FIGS. *9b* and *9c* with the play of the head in the feed direction enabling the sheet, simultaneously, to undergo residual movement in the direction of the front stop. By the time that the sheet is in registered engagement with the side stop 16 it has had opportunity to utilize the play in the feed direction settling, also, against the front stop 13, FIG. *9d* representing the fully registered condition at the end of the shifting stroke at which time the port 71 of the suction valve is in closed position and port 81 of the pressure valve is in open condition, applying a puff of compressed air through the auxiliary pressure tube 86. This serves both to break the residual vacuum and to unseat the sheet slightly from the head in readiness for removal of the sheet from the feed table.

In the event that it is necessary for the sheet to make a slight change in the direction of its movement in order to accommodate positioning against the side and front stops, as might occur where the sheet seats on one stop prior to engaging the other, it is possible for the head to rotate about its own (vertical) axis on its circular anti-friction bearing in either the clockwise or counterclockwise direction from neutral position as illustrated in FIGS. 10*a* and 10*b*, with such motion occurring simultaneously with the shifting motion illustrated in FIGS. *9a–9d*.

Figure 5:
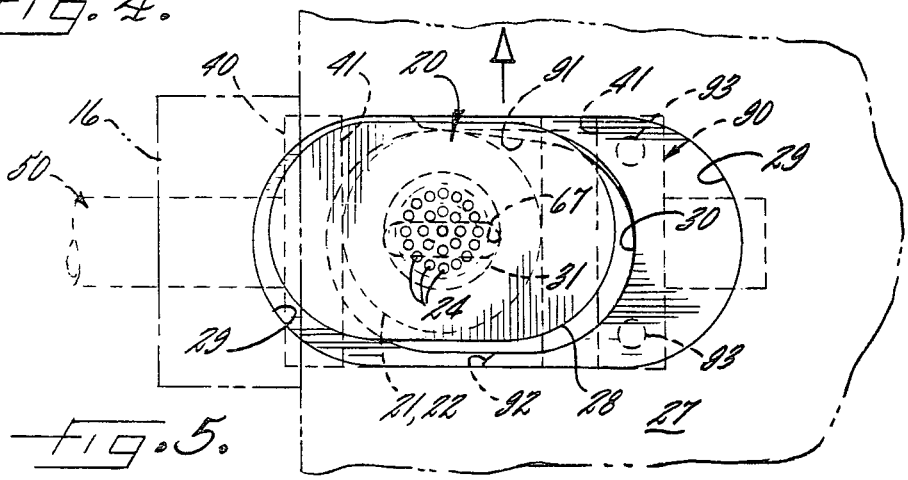
FIG. 5 is a fragmentary top view of the recessed suction head as viewed along line 5—5 in FIG. 3.

In accordance with one of the important aspects of the present invention the head has a reference position in the feed direction from which free play in the feed direction is available, and means are provided timed with the return stroke of the head for restoring the head to reference position thereby to insure that the full amount of play is available for the next sheet. Referring to FIGS. 5 and 11 there is shown a centering fork 90 of "U" shape having a first arm 91 and a second arm 92 and which is secured to the underside of the table by means of a pair of screws or the like 93. The arm 91 is the active arm which presents a camming surface arranged at an angle $\alpha$ serving to engage the profile of the head on its return stroke, away from the side guide, to restore the initial amount of play so that the full amount of play is available for the next sheet. While the element 90 has been referred to as a fork capable of centering the head in its reference position, it is the camming action performed by the arm 91 and not the centering effect as such which is the important function; consequently, the second arm 92 may, if desired, be omitted without affecting the utility of the construction.

While reference has been made to the head as having a "set" of openings, it will be understood that the term "set" is not limited to any particular number of openings and a single opening may be used if desired.

What I claim is:

1. In a device for registering a sheet against front and side stops on the feed table of a printing press having a press drive and means for cyclically feeding sheets across the table toward the front stop, the combination comprising a suction head recessed in the table adjacent to the side stop and having a set of openings which are flush with the table, the suction head being shiftable parallel to the surface of the table, reciprocating means coupled to the press drive and timed with the arrival of a sheet at the front stop for shifting the head laterally in the direction of the side stop and for returning it, a source of suction, valve means coupled to the source of suction for admitting suction to the head timed with the lateral shifting movement so that the sheet is shifted into contact with the side stop, anti-friction means for mounting the suction head for free play from a reference position in the direction of feeding movement so that the sheet is free to settle against the front stop as it is shifted by the head toward the side stop, and means timed with the return of the head for restoring it to reference position thereby to insure that the full amount of play is available for the next sheet.

2. In a device for registering a sheet against front and side stops on the feed table of a printing press having a press drive and having means for cyclically feeding sheets across the table toward the front stop, the combination comprising a suction head recessed in the table adjacent the side stop and having a top surface including a set of openings, means mounting the suction head for movement parallel to the surface of the table with the top surface of the head being maintained flush with the surface of the table, reciprocating means coupled to the press drive and timed with the arrival of the sheet at the front stop for shifting the head laterally in the direction of the side stop and for returning it, a local source of suction, first valve means coupled to the source of suction for admitting suction to the head timed with the lateral shifting movement so that the sheet is shifted into contact with the side stop, an auxiliary nozzle mounted for discharge below said openings, a local source of air pressure, and second valve means coupling the nozzle to the source of air pressure for applying a short puff of air to the openings timed with completion of the shifting movement to free the sheet from the head in readiness for removal of the sheet from the table.

3. In a device for registering a sheet against front and side stops on the feed table of a printing press having a press drive and having means for cyclically feeding sheets across the table toward the front stop, the combination comprising a suction head recessed in the table adjacent the side stop and having a set of openings which are flush with the table, the suction head being shiftable parallel to the surface of the table, reciprocating means coupled to the press drive and timed with the arrival of a sheet at the front stop for shifting the head laterally in the direction of the side stop and for returning it, a source of suction, first valve means coupled to the source of suction for admitting suction to the head timed with the lateral shifting movement so that the sheet is shifted into contact with the side stop, anti-friction means for mounting the suction head for free play from a reference position in the direction of feeding movement of the sheet so that the sheet is free to settle against the front stop as it is shifted by the head toward the side stop, a source of air pressure, second valve means coupled to the source of air pressure for applying a short puff of air to the head timed with completion of the shifting means to free the sheet from the head in readiness for removal of the sheet from the table, and means timed with the return of the head for restoring it to reference position thereby to insure that the full amount of play is available for the next sheet.

4. The combination as claimed in claim 1 or in claim 3 in which the head is mounted so as to be freely rockable through at least a limited angle about a central axis perpendicular to the surface of the table to accommodate slight changes in the angle of movement of the sheet as it moves into its final registered position.

5. The combination as claimed in claim 1 or in claim 3 in which the head is in the form of a hollow capsule having an air conduit in communication therewith, the air conduit having a lost motion type connection with respect to the head for permitting free play of the head in the direction of feeding movement.

6. The combination as claimed in claim 1 or in claim 3 in which the head is in the form of a hollow cylindrical capsule, the reciprocating means including a slide supporting the head, means extending between the slide and the head for mechanically coupling the same to impart lateral reciprocating movement to the head while permitting lost motion in a direction perpendicular to the direction of reciprocating movement to accommodate residual feeding movement of the sheet, the air conduit having provision for lost motion in the same perpendicular direction, and an anti-friction bearing interposed between the head and the slide for insuring that the lost motion occurs freely.

7. The combination as claimed in claim 1 or in claim 3 in which the head is in the form of a hollow cylindrical capsule having a central axis, the reciprocating means including a slide supporting the head, means for mechanically coupling the same to impart reciprocating movement to the head while permitting lost motion in a direction perpendicular thereto, means including an air conduit extending from the slide axially into the head, the air conduit having a slip joint permitting relative rocking of the head about its central axis and permitting lost motion in the same perpendicular direction, and a circular coaxially arranged anti-friction bearing interposed between the head and the slide for facilitating both the lost motion and the rocking movement.

8. The combination as claimed in claim 1 or in claim 3 in which the reciprocating means includes a slide, a stationary horizontally arranged hollow tube mounting the slide for reciprocating movement toward and away from the side stop, the suction head being mounted on the slide for reciprocating movement therewith, the valve means being connected to supply the tube so that the tube serves as an air conduit, and a sliding joint interposed between the tube and the head forming an air connection in all positions of movement of the slide.

9. The combination as claimed in claim 1 or in claim 3 in which the valve means includes a ported disc mounted on a drive shaft, the shaft being coupled to the press drive, the reciprocating means including a slide, and a cam and cam follower interposed between the shaft and the slide for reciprocating the latter synchronized with the operation of the valve means.

10. The combination as claimed in claim 3 in which the means for applying a short puff of air to the head includes an auxiliary tube for conducting air under pressure to a position below the openings in the head.

11. The combination as claimed in claim 3 in which the first and second valve means are in the form of ported discs mounted upon a drive shaft coupled to the press drive, the discs having adjacent annular chambers for evacuated air and pressurized air, respectively.

12. The combination as claimed in claim 1 or in claim 3 in which the means for restoring the head to reference position is in the form of a centering means actuated automatically during the lateral return stroke of the head.

13. The combination as claimed in claim 1 or in claim 3 in which the reciprocating means is in the form of a slide, a spring for imparting shifting movement to the slide, means including a cam and cam follower interposed between the press drive and the slide for returning the slide from its shifted position, and means including an adjustable stop arranged in the path of shifting movement of the slide for adjusting the length of the shifting stroke of the head.

14. The combination as claimed in claim 1 in which the reciprocating means includes a slide and a drive shaft with a cam and cam follower interposed inbetween and in which the valve means includes a ported disc mounted upon the shaft having its port cyclically coupled to the source of suction and so phased that suction is admitted to the head during lateral shifting movement of the head toward the side stop.

15. The combination as claimed in claim 3 in which the reciprocating means includes a slide mounting the head and a drive shaft with a cam and cam follower therebetween, the first valve means including a first ported disc on the shaft phased for cyclically connecting the head to the source of suction during the shifting movement of the head toward the side stop, said second valve means being in the form of a second ported disc on the shaft phased for cyclically connecting the head to the source of air pressure timed with completion of the shifting movement so that application of suction and application of air pressure to the head occur in closely spaced sequence for prompt release of the engaged sheet, the port in the first disc being arcuately longer than the port in the second disc.

16. In a device for registering a sheet against front and side stops on the feed table of a printing press having a press drive and having means for cyclically feeding sheets across the table toward the front stop, the combination comprising a suction head recessed in the table adjacent the side stop and having a set of openings which are flush with the table, the suction head being shiftable parallel to the surface of the table, reciprocating means coupled to the press drive and timed with the arrival of the sheet at the front stop for shifting the head laterally in the direction of the side stop and for returning it, a source of suction, first valve means coupled to the source of suction for admitting suction to the head timed with the lateral shifting movement so that the sheet is shifted into contact with the side stop, a source of air pressure, second valve means coupled to the source of air pressure for applying a short puff of air to the head timed with completion of the shifting movement to free the sheet from the head in readiness for removal of the sheet from the table, the head being in the form of a hollow capsule having an air conduit in communication therewith, the air conduit having a lost motion type connection with respect to the head for permitting free play of the head in the direction of feeding movement.

17. In a device for registering a sheet against front and side stops on the feed table of a printing press having a press drive and having means for cyclically feeding sheets across the table toward the front stop, the combination comprising a suction head recessed in the table adjacent the side stop and having a set of openings which are flush with the table, the suction head being shiftable parallel to the surface of the table, reciprocating means coupled to the press drive and timed with the arrival of the sheet at the front stop for shifting the head laterally in the direction of the side stop and for returning it, a source of suction, first valve means coupled to the source of suction for admitting suction to the head timed with the lateral shifting movement so that the sheet is shifted into contact with the side stop, a source of air pressure, second valve means coupled to the source of air pressure for applying a short puff of air to the head timed with completion of the shifting movement to free the sheet from the head in readiness for removal of the sheet from the table, the head being in the form of a hollow cylindrical capsule, the reciprocating means including a slide supporting the head, means extending between the slide and the head for mechanically coupling the same to impart lateral reciprocating movement to the head while permitting lost motion in a direction perpendicular to the direction of reciprocating movement to accommodate residual feeding movement of the sheet, the air conduit having provision for lost motion in the same perpendicular direction, and an anti-friction bearing interposed between the head and the slide for insuring that the lost motion occurs freely.

18. In a device for registering a sheet against front and side stops on the feed table of a printing press having a press drive and having means for cyclically feeding sheets across the table toward the front stop, the combination comprising a suction head recessed in the table adjacent the side stop and having a set of openings which are flush with the table, the suction head being shiftable parallel to the surface of the table, reciprocating means coupled to the press drive and timed with the arrival of the sheet at the front stop for shifting the head laterally in the direction of the side stop and for returning it, a source of suction, first valve means coupled to the source of suction for admitting suction to the head timed with the lateral shifting movement so that the sheet is shifted into contact with the side stop, a source of air pressure, second valve means coupled to the source of air pressure for applying a short puff of air to the head timed with completion of the shifting movement to free the sheet from the head in readiness for removal of the sheet from the table, the head being in the form of a hollow cylindrical capsule having a central axis, the reciprocating means including a slide supporting the head, means for mechanically coupling the same to impart reciprocating movement to the head while permitting lost motion in a direction perpendicular thereto, means including an air conduit extending from the slide axially into the head, the air conduit having a slip joint permitting relative rocking of the head about its central axis and permitting lost motion in the same perpendicular direction, and a circular coaxially arranged anti-friction bearing interposed between the head and the slide for facilitating both the lost motion and the rocking movement.

19. In a device for registering a sheet against front and side stops on the feed table of a printing press having a press drive and having means for cyclically feeding sheets across the table toward the front stop, the combination comprising a suction head recessed in the table adjacent the side stop and having a set of openings which are flush with the table, the suction head being shiftable parallel to the surface of the table, reciprocating means coupled to the press drive and timed with the arrival of the sheet at the front stop for shifting the head laterally in the direction of the side stop and for returning it, a source of suction, first valve means coupled to the source of suction for admitting suction to the head timed with the lateral shifting movement so that the sheet is shifted into contact with the side stop, a source of air pressure, second valve means coupled to the source of air pressure for applying a short puff of air to the head timed with completion of the shifting movement to free the sheet from the head in readiness for removal of the sheet from the table, the reciprocating means being in the form of a slide, a spring for imparting shifting movement to the slide, means including a cam and cam follower interposed between the press drive and the slide for returning the slide from its shifted position, and means including an adjustable stop arranged in the path of shifting movement of the slide for adjusting the length of the shifting stroke of the head.

* * * * *